US010821576B2

(12) United States Patent
Jokinen

(10) Patent No.: US 10,821,576 B2
(45) Date of Patent: Nov. 3, 2020

(54) TIGHTENING DEVICE FOR TIGHTENING PIPE CONNECTION

(71) Applicant: Jukka Jokinen, Isnäs (FI)

(72) Inventor: Jukka Jokinen, Isnäs (FI)

( * ) Notice: Subject to any disclaimer, the term of this patent is extended or adjusted under 35 U.S.C. 154(b) by 227 days.

(21) Appl. No.: 16/083,629

(22) PCT Filed: Mar. 11, 2016

(86) PCT No.: PCT/FI2016/050153

§ 371 (c)(1),
(2) Date: Sep. 10, 2018

(87) PCT Pub. No.: WO2017/153629

PCT Pub. Date: Sep. 14, 2017

(65) Prior Publication Data

US 2019/0061115 A1 Feb. 28, 2019

(51) Int. Cl.
*B25B 21/00* (2006.01)
*B25B 13/48* (2006.01)
(Continued)

(52) U.S. Cl.
CPC ..... *B25B 21/004* (2013.01); *B25B 13/466* (2013.01); *B25B 13/48* (2013.01);
(Continued)

(58) Field of Classification Search
CPC ... B25B 23/0078; B25B 13/48; B25B 21/004; B25B 13/466; B25B 13/5033;
(Continued)

(56) References Cited

U.S. PATENT DOCUMENTS 6,148,695 A * 11/2000 Hu ..... B25B 13/463 81/60
2004/0159191 A1* 8/2004 Putney ..... B25B 13/466 81/57.39

(Continued)

FOREIGN PATENT DOCUMENTS

| | | |
|---|---|---|
| JP | 2003/191173 | 7/2003 |
| JP | 3198346 | 7/2015 |
| WO | WO 2015/139225 | 9/2015 |

OTHER PUBLICATIONS

Office Action issued in Japan, Application No. 2018-566648, dated Aug. 16, 2019 (with translation), 9 pages.

(Continued)

*Primary Examiner* — Robert J Scruggs
(74) *Attorney, Agent, or Firm* — Nixon & Vanderhye P.C.

(57) ABSTRACT

A tightening device for tightening a pipe connection, the tightening device comprising a frame (2), a reciprocating member (4) adapted to reciprocate between a first position and a second position relative to the frame (2) by pivoting about a first axis of rotation (101), a socket member (6) adapted for rotating a connector nut (52) of a pipe connection, the socket member (6) having an open side for enabling accessing a rotation axis of the socket member (6) from a radial direction, and a drive coupling between the reciprocating member (4) and the socket member (6). During use of the tightening device a reciprocating motion of the reciprocating member (4) between the first position and the second position provides unidirectional rotation of the socket member (6) in the first direction of rotation.

12 Claims, 7 Drawing Sheets

(51) Int. Cl.
*B25B 13/46* (2006.01)
*B25B 23/00* (2006.01)
*B25B 13/50* (2006.01)

(52) U.S. Cl.
CPC ..... *B25B 13/5033* (2013.01); *B25B 23/00* (2013.01); *B25B 23/0085* (2013.01)

(58) Field of Classification Search
CPC ... B25B 23/00; B25B 23/0085; B25B 21/002; B25B 21/00; B25B 17/00
See application file for complete search history.

(56) References Cited

U.S. PATENT DOCUMENTS

| | | | | |
|---|---|---|---|---|
| 2008/0196555 | A1* | 8/2008 | Yoon | B25B 21/02 81/57.11 |
| 2009/0120244 | A1 | 5/2009 | Lu et al. | |
| 2013/0036874 | A1* | 2/2013 | Chan | B25B 21/004 81/58.2 |
| 2015/0047472 | A1* | 2/2015 | Palmer | B25B 13/46 81/63.1 |
| 2016/0075003 | A1 | 3/2016 | Hu et al. | |

OTHER PUBLICATIONS

Search Report issued in EP Appln. No. 16893353.9 dated Feb. 12, 2019.
International Search Report for PCT/FI2016/050153 dated Jul. 5, 2016, 4 pages.
Written Opinion for PCT/FI2016/050153 dated Jul. 5, 2016, 9 pages.

* cited by examiner

TIGHTENING DEVICE FOR TIGHTENING PIPE CONNECTION

This application is the U.S. national phase of International Application No. PCT/FI2016/050153 filed Mar. 11, 2016 which designated the U.S., the entire contents of which are hereby incorporated by reference.

FIELD OF THE INVENTION

The present invention relates to a tightening device for tightening a pipe connection.

A known pipe connection comprises a tube, a cutting ring, a connector nut and a connector body. A thread of the connector body is adapted to co-operate with a thread of the connector nut. An example of such a pipe connection is disclosed in the standard DIN 2353.

A known method for tightening a pipe connection comprises using two open-ended spanners. A first open-ended spanner is used to rotate a connector nut of a pipe connection while a second open-ended spanner is used to retain a connector body of the pipe connection. It should be noted that in a general case it is not possible to use ring spanners because of a pipe or pipes of the pipe connection.

One of the problems associated with the above tightening method utilizing open-ended spanners is that during a tightening of a pipe connection it is usually necessary to disengage several times the open-ended spanner that is used to rotate a connector nut. Said disengaging is necessary because there is rarely space to rotate the open-ended spanner in a large angle, not to mention in a full circle.

BRIEF DESCRIPTION OF THE INVENTION

An object of the present invention is to provide a tightening device for tightening a pipe connection so as to solve the above problem. The object of the invention is achieved by a tightening device which is characterized by what is stated in the independent claim 1. The preferred embodiments of the invention are disclosed in the dependent claims.

The invention is based on the idea of providing a tightening device with an open sided socket member rotated by a reciprocating member adapted to reciprocate between two positions by pivoting about an axis of rotation that coincides with an axis of rotation of the open sided socket member.

An advantage of the tightening device of the invention is that there is no need to disengage and engage the tightening device repeatedly even when a connector nut is rotated several full turns and there is limited space around the pipe connection to be tightened. A frame of the tightening device does not rotate relative to the connector body during a tightening process.

In an embodiment a tightening device of the invention is adapted to be connected to a torque wrench thereby allowing an accurate control of the tightening torque of the tightening device. Such control cannot be realized in a known tightening method utilizing two open-ended spanners.

BRIEF DESCRIPTION OF THE DRAWINGS

In the following the invention will be described in greater detail by means of preferred embodiments with reference to the attached drawings, in which.

DETAILED DESCRIPTION OF THE INVENTION

Figure 1:
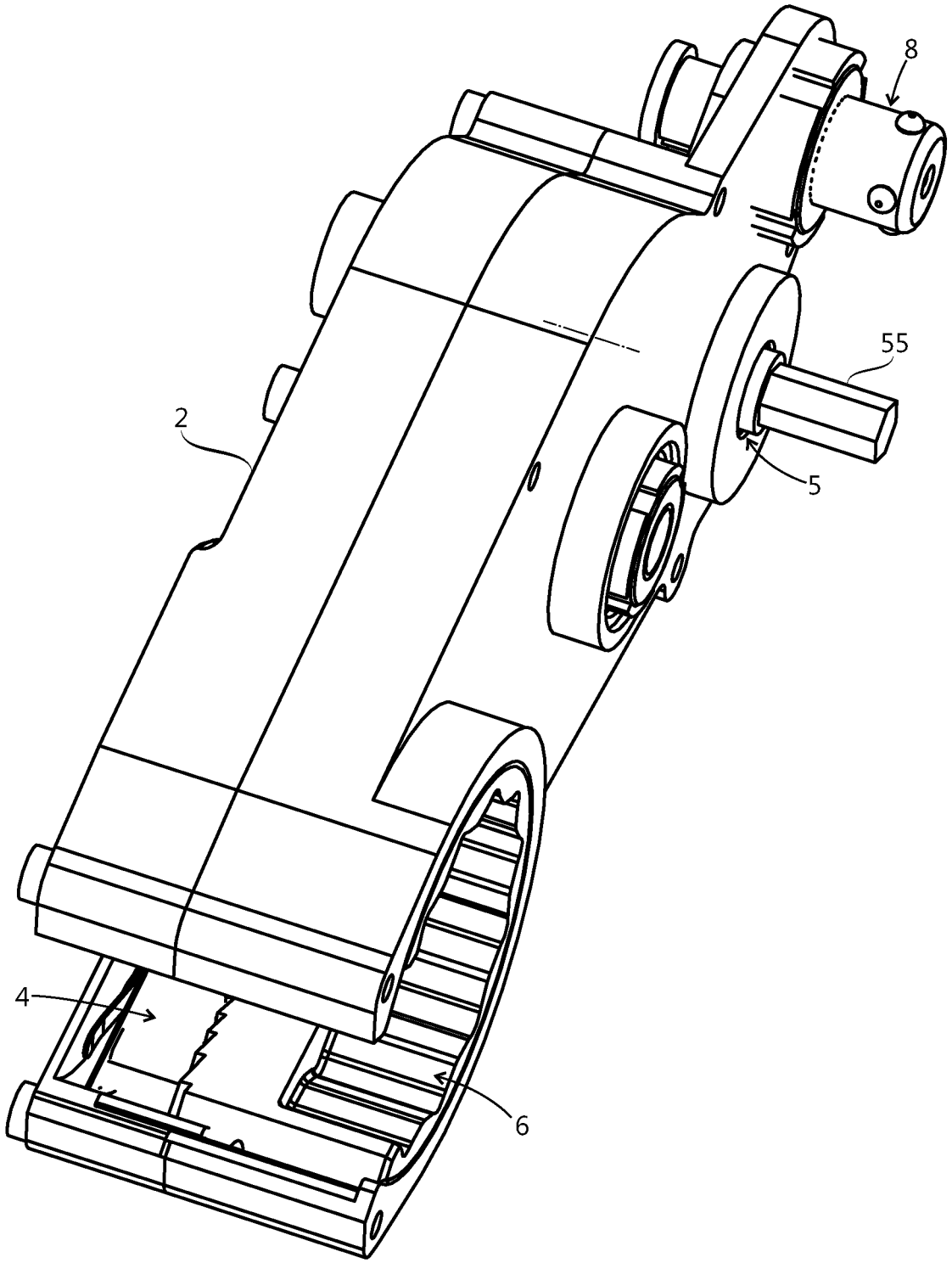
FIG. 1 shows a tightening device according to an embodiment of the invention.
Figure 2:
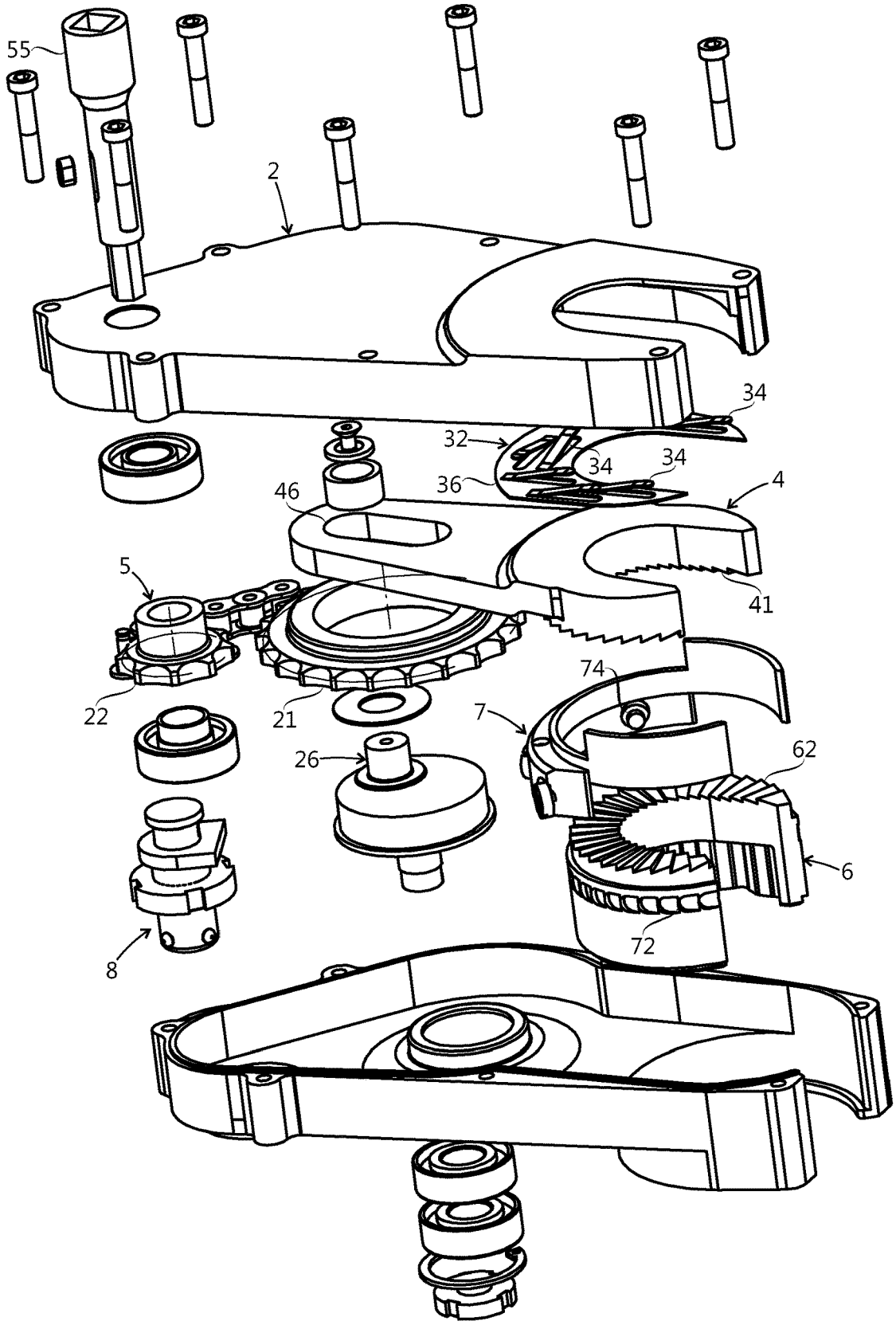
FIG. 2 is an exploded view of the tightening device of FIG. 1.

FIG. 1 shows a tightening device according to an embodiment of the invention. FIG. 2 is an exploded view of the tightening device of FIG. 1. The tightening device of FIG. 1 comprises a frame 2, a reciprocating member 4 adapted to reciprocate between a first position and a second position relative to the frame 2 by pivoting about a first axis of rotation, power input means 5 for inputting mechanical power into the tightening device, drive system for transferring driving force from the power input means 5 to the reciprocating member 4 and a socket member 6 adapted for rotating a connector nut of a pipe connection, the socket member 6 being adapted to be rotated relative to the frame 2 about a rotation axis of the socket member 6, the rotation axis of the socket member 6 coinciding with the first axis of rotation.

The tightening device only partially surrounds the first axis of rotation. The socket member 6 has an open side for enabling accessing the rotation axis of the socket member 6 from a radial direction. Further, the entire tightening device has an open side for enabling accessing the first axis of rotation from a radial direction. The radial direction is a direction perpendicular to the axis in question.

An inner surface of the socket member 6 is adapted to directly engage a connector nut of a pipe connection. In an alternative embodiment a socket member comprises a replaceable socket bit adapted to engage a connector nut of a pipe connection, the socket bit having an open side.

The power input means 5 are adapted to be connected to a torque wrench selectively on either side of the frame 2 in axial direction. The power input means 5 comprises a pipe shaft accessible from both sides of the frame 2, and a detachable adapter element 55 adapted to be in power transmission connection with the pipe shaft. Rotation axis of the pipe shaft is parallel to the first axis of rotation.

Figure 3A:
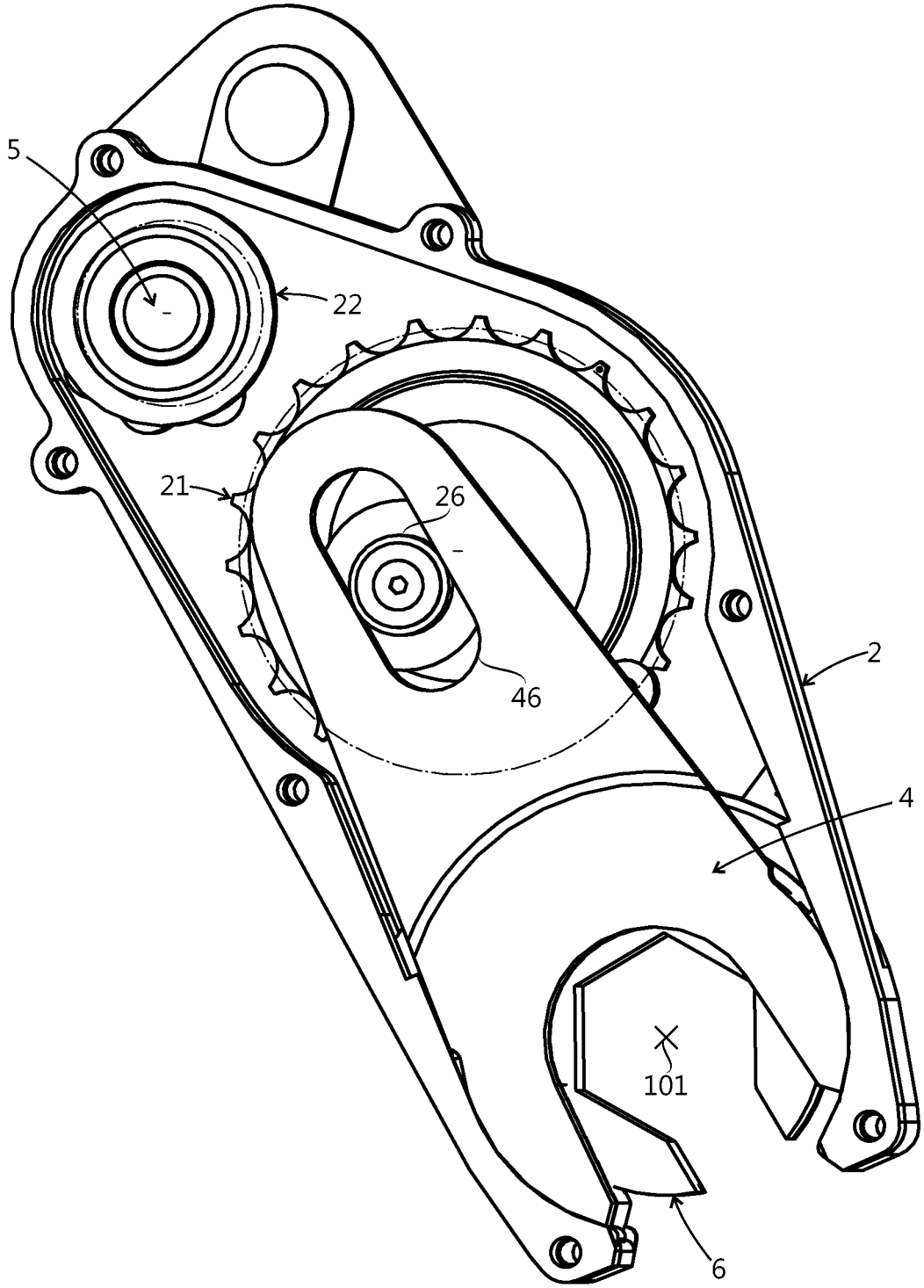
FIGS. 3A and 3B illustrate a drive system of the tightening device of FIG. 1.
Figure 3B:
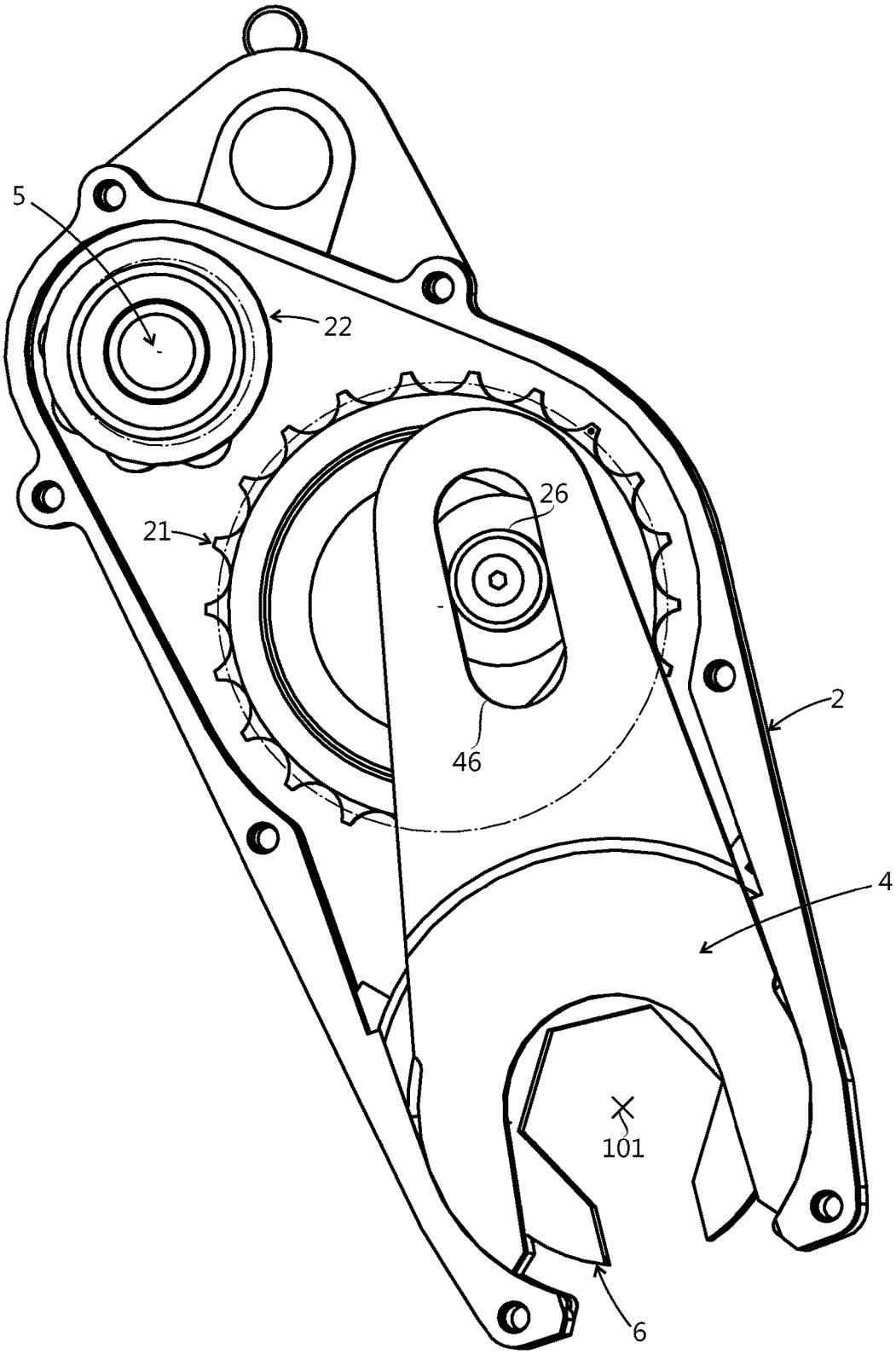

FIGS. 3A and 3B illustrate the drive system of the tightening device of FIG. 1. In FIGS. 3A and 3B the tightening device is in a partially disassembled state. In FIG. 3A the reciprocating member 4 is in the first position relative to the frame 2. In FIG. 3B the reciprocating member 4 is in the second position relative to the frame 2. The first axis of rotation about which the reciprocating member 4 reciprocates, is denoted with reference numeral 101.

The drive system has a transmission ratio adapted to increase torque between the power input means 5 and the reciprocating member 4. The drive system comprises a drive slot 46 provided on the reciprocating member 4, a first drive gear 21, a second drive gear 22 and a chain adapted to transfer power from the second drive gear 22 to the first drive gear 21. The second drive gear 22 has fewer teeth than the first drive gear 21. In FIGS. 3A and 3B neither the chain nor teeth of the second drive gear 22 are shown.

The first drive gear 21 is adapted to be rotated relative to the frame 2 about a rotation axis which is parallel to and spaced apart from the first axis of rotation 101. The first drive gear 21 is provided with a drive pin 26 on a surface of the first drive gear 21 extending perpendicular to the first axis of rotation 101. A centre of the drive pin 26 is located at a distance from the rotation axis of the first drive gear 21. The drive slot 46 is adapted to co-operate with the drive pin 26 for transferring driving force from the first drive gear 21 to the reciprocating member 4 such that unidirectional rotation of the first drive gear 21 provides reciprocation of the reciprocating member 4 between the first position and the second position relative to the frame 2. The co-operation is realized such that the drive pin 26 is received in the drive slot 46. The drive slot 46 extends substantially linearly in a direction perpendicular to the first axis of rotation 101. The drive slot 46 is spaced apart from the first axis of rotation 101.

The drive pin 26 is adapted to move between a first pin position and a second pin position in the drive slot 46 relative to the reciprocating member 4. A distance between the first pin position and the second pin position equals a travel of pin. FIGS. 3A and 3B show that the drive pin 26 is situated in a middle region of the travel of pin both in the first position and the second position of the reciprocating member 4, the middle region being the middle third of the travel of pin.

There is a drive coupling between the reciprocating member 4 and the socket member 6, the drive coupling being adapted for transferring driving force from the reciprocating member 4 to the socket member 6 in a first direction of rotation, and to prevent transfer of driving force from the reciprocating member 4 to the socket member 6 in a second direction of rotation opposite to the first direction of rotation, such that during use of the tightening device a reciprocating motion of the reciprocating member 4 between the first position and the second position provides unidirectional rotation of the socket member 6 in the first direction of rotation.

The drive coupling comprises first tooth means on a drive surface of the reciprocating member 4, and second tooth means on a drive surface of the socket member 6. The first tooth means comprise a plurality of first teeth 41, and the second tooth means comprise a plurality of second teeth 62. Both the drive surface of the reciprocating member 4 and the drive surface of the socket member 6 extend perpendicular to the first axis of rotation 101. The second tooth means are adapted to co-operate with the first tooth means for transferring driving force from the reciprocating member 4 to the socket member 6.

The drive coupling between the reciprocating member 4 and the socket member 6 is adapted to allow axial movement between the first tooth means and the second tooth means in order to enable disengaging the first tooth means from transmission engagement with the second tooth means during rotation of the reciprocating member 4 in the second direction of rotation. The reciprocating member 4 is adapted to move axially relative to the frame 2 for disengaging the first tooth means from the second tooth means. Herein, axial direction is a direction parallel to the first axis of rotation 101.

The drive coupling comprises pressing means for pressing the reciprocating member 4 towards the socket member 6. The pressing means are adapted to axially return the first tooth means from a disengaged position to an engaged position with relation to the second tooth means by exerting an axial force to the reciprocating member 4 towards the socket member 6. The pressing means comprise a flat spring element 32 between the frame 2 and the reciprocating member 4. The flat spring element 32 comprises eight flat spring members 34 protruding from a body part 36. In an alternative embodiment the pressing means comprise at least one coil spring between the frame and the reciprocating member. In a further alternative embodiment the pressing means comprise at least one magnet.

In an alternative embodiment a drive coupling between a reciprocating member and a socket member comprises a first friction surface on the reciprocating member, and a second friction surface on the socket member. The first friction surface is located on a drive surface of the reciprocating member that extends perpendicular to the first axis of rotation. The second friction surface is located on a drive surface of the socket member that extends perpendicular to the first axis of rotation. It should be noted that replacing first tooth means and second tooth means with friction surfaces requires designing pressing means such that the pressing means are adapted to exert an axial force sufficient for torque transfer of the friction surfaces. For example, the pressing means can comprise a hydraulic pressing mechanism which is adapted to be in a pressing state during movement of the reciprocating member in the first direction of rotation, and in a released state during movement of the reciprocating member in the second direction of rotation.

Both directions of rotation of the first drive gear 21 are adapted to provide unidirectional rotation of the socket member 6 in the first direction of rotation. However, the tightening device of FIG. 1 is optimized for rotating the first drive gear 21 in the same direction as the socket member 6.

Figure 4A:
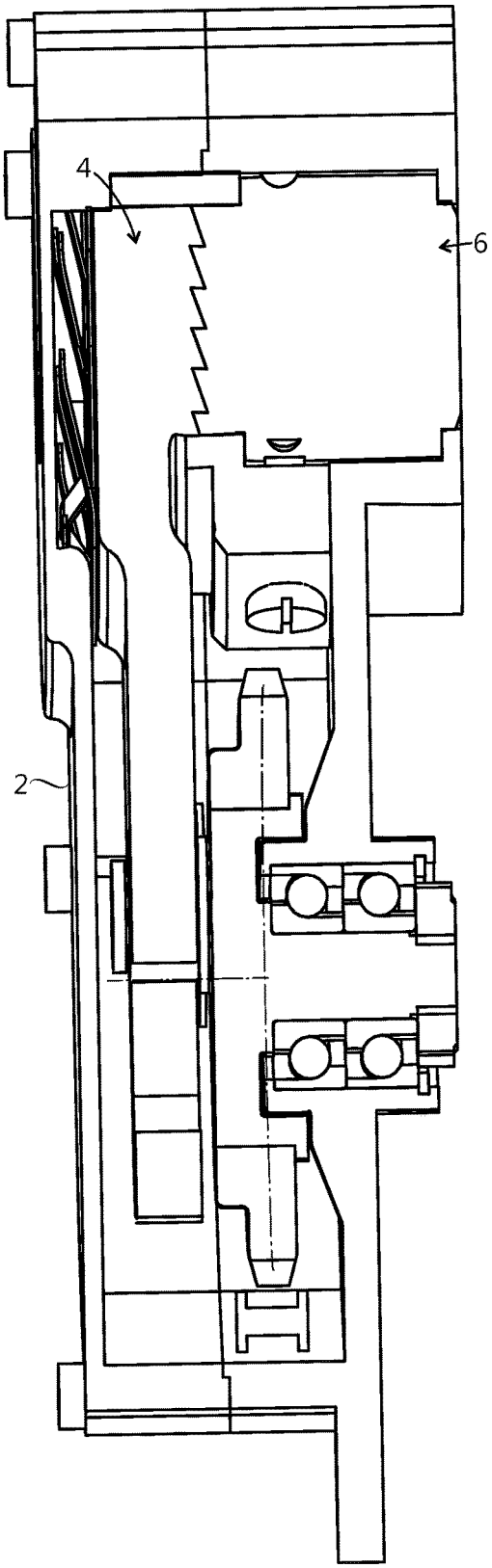
FIG. 4A is a sectional view of the tightening device of FIG. 1 with first tooth means in an engaged position relative to second tooth means.
Figure 4B:
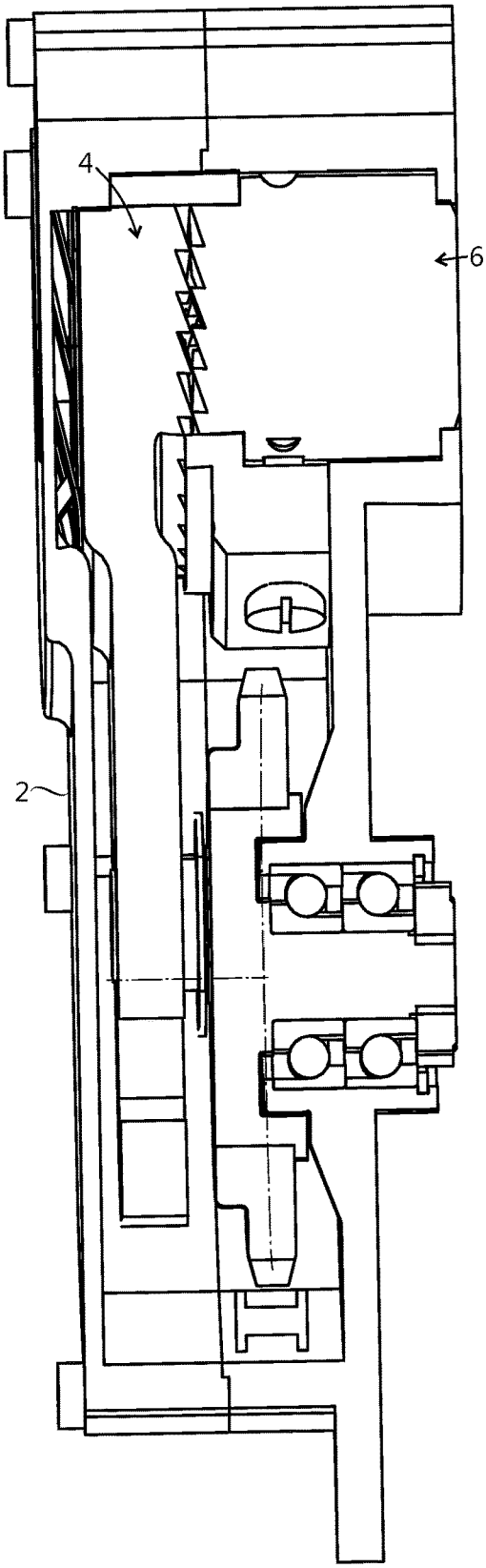
FIG. 4B is a sectional view of the tightening device of FIG. 1 with first tooth means in a disengaged position relative to second tooth means.

FIGS. 4A and 4B are sectional views of the tightening device of FIG. 1 as seen from a direction perpendicular to the first axis of rotation. In FIG. 4A the first tooth means of the reciprocating member 4 are in transmission engagement with the second tooth means of the of the socket member 6. In FIG. 4B the first tooth means of the reciprocating member 4 are in a disengaged position relative to the second tooth means of the of the socket member 6. In other words, in FIG. 4B an axial distance between the reciprocating member 4 and the socket member 6 is greater than in FIG. 4A. In the situation shown in FIG. 4B the pressing means press the reciprocating member 4 towards the socket member 6. The socket member 6 does not move axially relative to the frame 2.

Figure 5:
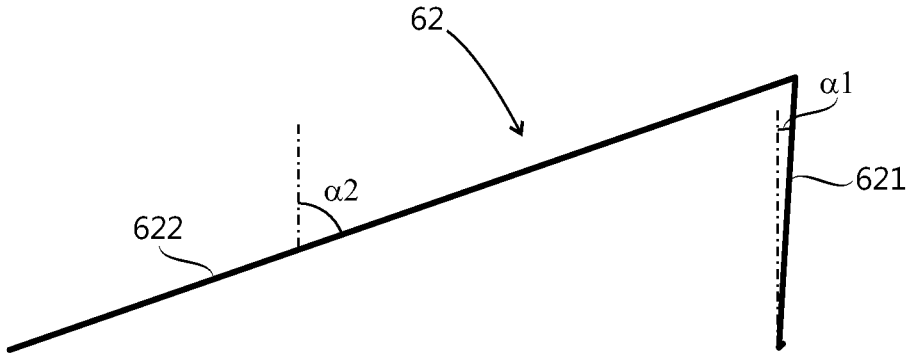
FIG. 5 shows an enlargement of a second tooth of a socket member.

FIG. 5 shows an enlargement of a second tooth 62 of the socket member 6. The second tooth 62 is an asymmetric tooth. A pressure angle $\alpha 1$ of surface 621 of the second tooth 62 that co-operates for transferring driving force from the reciprocating member 4 to the socket member 6 in the first direction of rotation is substantially smaller than a pressure angle $\alpha 2$ of surface 622 of the second tooth 62 that co-operate for transferring force from the reciprocating member 4 to the socket member 6 in the second direction of rotation. The pressure angle $\alpha 1$ is $-2°$ and the pressure angle $\alpha 2$ is $70°$. Pressure angles of the first teeth 41 are matched with the pressure angles $\alpha 1$ and $\alpha 2$ of the second teeth 62.

Due to the negative value of the pressure angle $\alpha 1$, transfer of driving force from the reciprocating member 4 to the socket member 6 in the first direction of rotation creates no axial forces pulling the reciprocating member 4 and the socket member 6 apart. In alternative embodiments, pressure angles of surfaces adapted for transferring driving force from the reciprocating member to the socket member in the first direction of rotation are in the range of −0.5° to −5°.

Difference between the pressure angles α2 and α1 is 72°. In an alternative embodiment, difference between the pressure angles of surfaces adapted for transferring force from the reciprocating member to the socket member in the second and first directions is in the range of 30° to 85°.

The large positive value of the pressure angle α2 prevents transfer of driving force from the reciprocating member 4 to the socket member 6 in the second direction of rotation. Herein preventing transfer of driving force means that the drive coupling between the reciprocating member 4 and the socket member 6 is capable of transferring a fraction of torque through the surface 622 and a counter surface thereof when compared with the torque the drive coupling is capable of transferring through the surface 621 and a counter surface thereof. Said fraction of torque can be one fifth or less, for example. Consequently the drive coupling is adapted to transfer a significantly higher torque in the first direction of rotation compared with the second direction of rotation.

During movement of the reciprocating member 4 in the second direction of rotation the first teeth 41 bounce in the axial direction relative to the second teeth 62 without transferring a significant torque. It should be noted that design of the pressing means affects torque transfer capability of the drive coupling. For example, stiffness of the flat spring element 32 affects torque transfer capability of the drive coupling. Designing the spring element stiffer allows the drive coupling to transfer more torque in the second direction of rotation.

Figure 6:
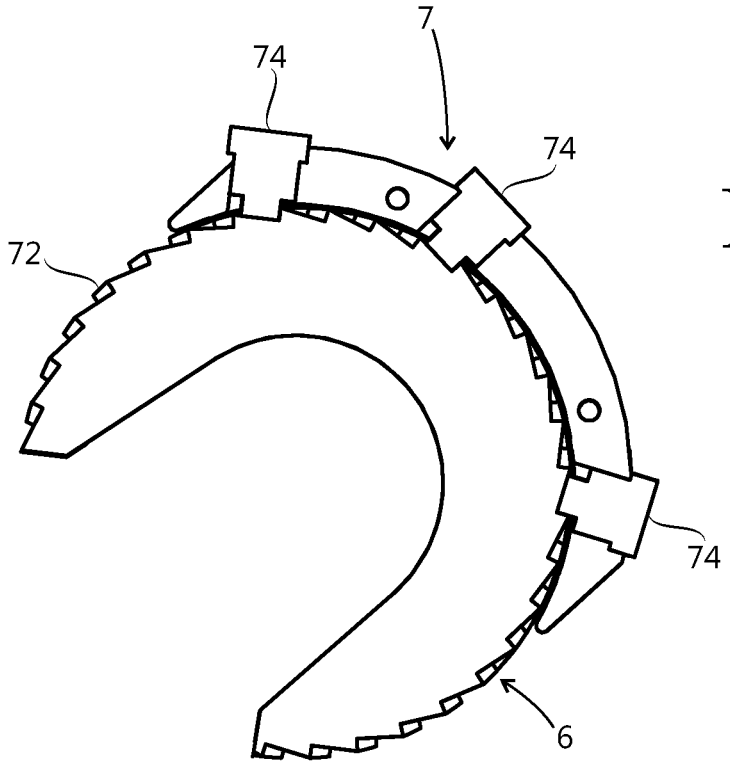
FIG. 6 shows a sectional view of a ratchet mechanism of the tightening device of FIG. 1.

The tightening device comprises a ratchet mechanism 7 adapted to allow rotation of the socket member 6 in the first direction of rotation, and to prevent rotation of the socket member 6 in the second direction of rotation. FIG. 6 shows a sectional view of the ratchet mechanism 7 from a direction parallel to the first axis of rotation. The ratchet mechanism 7 comprises a plurality of ratchet teeth 72 provided on the socket member 6 and three pawls 74 adapted to co-operate with the plurality of ratchet teeth 72. The ratchet mechanism 7 also comprises a pawl spring for each pawl 74. The pawl springs are not shown in the Figures. In FIG. 6 the first direction of rotation is clockwise.

An angle between adjacent ratchet teeth 72 is equal to an angle between adjacent second teeth 62. The angle between adjacent ratchet teeth 72 is 10°. The ratchet teeth 72 are offset relative to the second teeth 62. An offset angle between the ratchet teeth 72 and the second teeth 62 is 3°. In an alternative embodiment an offset angle between ratchet teeth and second teeth is in the range of 1° to 5°. The offset angle is adapted to allow the socket member 6 to rotate slightly in the second direction of rotation after the first tooth means have disengaged from the transmission engagement with the second tooth means. An appropriate offset angle relieves tension between a tightening device assembly and a pipe connection tightened by the tightening device assembly, and therefore facilitates disconnecting a tightening device from a pipe connection after the pipe connection has been tightened by the tightening device.

The ratchet teeth 72 are located on a peripheral surface of the socket member 6 extending perpendicular to a radial direction of the socket member 6. In an alternative embodiment second teeth on a drive surface of a socket member extending perpendicular to the first axis of rotation are adapted to function as ratchet teeth.

Figure 7:
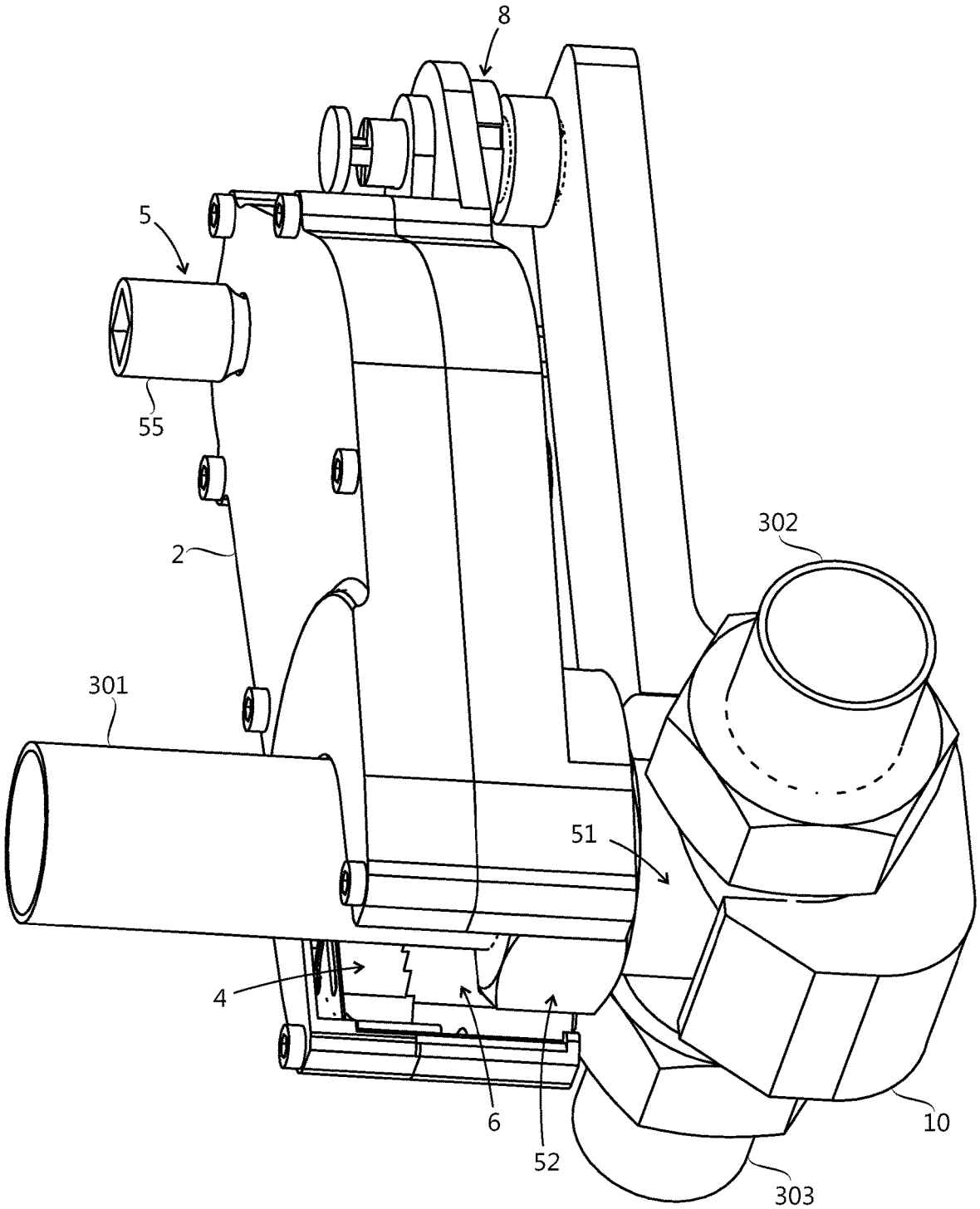
FIG. 7 illustrates tightening of a pipe connection with a tightening device assembly comprising the tightening device of FIG. 1 and a locking member fastened to the tightening device.

FIG. 7 illustrates tightening of a high-pressure pipe connection of a hydraulic system with a tightening device assembly comprising the tightening device of FIG. 1, and a locking member 10 fastened to the tightening device. The pipe connection shown in FIG. 7 comprises a connector body 51 having a connector body thread, and a connector nut 52 having a nut thread adapted to co-operate with the connector body thread. Pipes connected to the connector body 51 are denoted with reference numerals 301, 302 and 303.

In FIG. 7 the locking member 10 is in contact with the connector body 51, and the socket member 6 is in contact with the connector nut 52. The socket member 6 is adapted for rotating the connector nut 52. The locking member 10 co-operates with the socket member 6 for tightening the pipe connection such that the locking member 10 retains the connector body 51 of the pipe connection such that rotation of the connector body 51 is prevented relative to the frame 2. A centre line of the pipe 301 coincides with the rotation axis of the socket member 6, and therefore also with the first axis of rotation. During tightening of the pipe connection the frame 2 of the tightening device does not rotate relative to the pipe 301.

After the pipe connection shown in FIG. 7 has been tightened to its final tightness, the locking member 10 is detached from the tightening device. Then the tightening device is moved farther from the connector body 51 in axial direction such that the socket member 6 is no longer in contact with the connector nut 52. If the socket member 6 is in a disadvantageous position hindering detaching the tightening device from the pipe 301, the socket member 6 is rotated to a better position relative to the frame 2 by inputting power to the tightening device through the power input means 5. Finally, the tightening device is moved away from the pipe 301.

It will be obvious to a person skilled in the art that the inventive concept can be implemented in various ways. The invention and its embodiments are not limited to the examples described above but may vary within the scope of the claims.

The invention claimed is:

1. A tightening device for tightening a pipe connection comprising a connector body having a connector body thread, and a connector nut having a nut thread adapted to co-operate with the connector body thread, wherein the tightening device comprises:

a frame;

a reciprocating member adapted to reciprocate between a first position and a second position relative to the frame by pivoting about a first axis of rotation;

power input means for inputting mechanical power into the tightening device;

drive system for transferring driving force from the power input means to the reciprocating member;

a socket member adapted for rotating a connector nut of a pipe connection, the socket member being adapted to be rotated relative to the frame about a rotation axis of the socket member, the rotation axis of the socket member coinciding with the first axis of rotation, the socket member having an open side for enabling accessing the rotation axis of the socket member from a radial direction; and a drive coupling between the reciprocating member and the socket member, the drive coupling being adapted for transferring driving force from the reciprocating member to the socket member in a first direction of rotation, and to prevent transfer of driving force from the reciprocating member to the socket member in a second direction of rotation opposite to the first direction of rotation, such that during use of the tightening device a reciprocating motion of the reciprocating member between the first position and the second position provides unidirectional rotation of the socket member in the first direction of rotation, wherein the drive coupling comprises first tooth means on a drive surface of the reciprocating member, the first tooth means comprising a plurality of first teeth, the drive surface of the reciprocating member extending perpendicular to the first axis of rotation; and second tooth means on a drive surface of the socket member, the second tooth means comprising a plurality of second teeth, the drive surface of the socket member extending perpendicular to the first axis of rotation, the second tooth means being adapted to co-operate with the first tooth means for transferring driving force from the reciprocating member to the socket member, the drive coupling being adapted to allow axial movement between the first tooth means and the second tooth means in order to enable disengaging the first tooth means from transmission engagement with the second tooth means during rotation of the reciprocating member in the second direction of rotation, wherein the drive system comprises a first drive gear adapted to be rotated relative to the frame about a rotation axis which is parallel to and spaced apart from the first axis of rotation, the first drive gear being provided with a drive pin on a surface of the first drive gear extending perpendicular to the first axis of rotation, a centre of the drive pin being located at a distance from the rotation axis of the first drive gear, and a drive slot provided on the reciprocating member, the drive slot being adapted to co-operate with the drive pin for transferring driving force from the first drive gear to the reciprocating member such that unidirectional rotation of the first drive gear provides reciprocation of the reciprocating member between the first position and the second position relative to the frame.

2. The tightening device according to claim 1, wherein each of the first teeth and second teeth is an asymmetric tooth such that pressure angles of surfaces of the first teeth and second teeth that co-operate for transferring driving force from the reciprocating member to the socket member in the first direction of rotation are smaller than pressure angles of surfaces of the first teeth and second teeth that co-operate for transferring force from the reciprocating member to the socket member in the second direction of rotation.

3. The tightening device according to claim 1, wherein the first tooth means and the second tooth means are formed such that transfer of driving force from the reciprocating member to the socket member in the first direction of rotation creates no axial forces pulling the reciprocating member and the socket member apart.

4. The tightening device according to claim 3, wherein each first tooth and second tooth comprises a surface whose pressure angle is a negative angle, the surface being adapted for transferring driving force from the reciprocating member to the socket member in the first direction of rotation.

5. The tightening device according to claim 4, wherein said pressure angle is in the range of −0.5° to −5°.

6. The tightening device according to claim 1, wherein the drive coupling comprises pressing means for pressing the reciprocating member towards the socket member, the pressing means being adapted to axially return the first tooth means from a disengaged position to an engaged position with relation to the second tooth means.

7. The tightening device according to claim 6, wherein the pressing means comprise at least one spring between the frame and the reciprocating member.

8. The tightening device according to claim 1, wherein the tightening device comprises fastening means for fastening a locking member to the frame, the locking member being adapted to co-operate with the socket member for tightening a pipe connection, the locking member being adapted to retain a connector body of the pipe connection such that rotation of the connector body is prevented relative to the frame.

9. The tightening device according to claim 1, wherein the drive pin is adapted to move between a first pin position and a second pin position in the drive slot, a distance between the first pin position and the second pin position equals a travel of pin, and the drive pin is adapted to be situated within a middle region of the travel of pin both in the first position and the second position of the reciprocating member.

10. The tightening device according to claim 1, wherein the tightening device comprises a ratchet mechanism adapted to allow rotation of the socket member in the first direction of rotation, and to prevent rotation of the socket member in the second direction of rotation.

11. The tightening device according to claim 1, wherein the drive system has a transmission ratio adapted to increase torque between the power input means and the reciprocating member.

12. The tightening device according to claim 1, wherein the power input means is adapted to be connected to a torque wrench selectively on either side of the frame in axial direction.

* * * * *